US011571351B2

(12) United States Patent
Du

(10) Patent No.: US 11,571,351 B2
(45) Date of Patent: Feb. 7, 2023

(54) FOLDABLE MASSAGE CHAIR WITH TRIANGULAR SUPPORT CONFIGURATION

(71) Applicant: SHANGHAI XINTANG INDUSTRIAL CO., LTD., Shanghai (CN)

(72) Inventor: Chuankui Du, Shanghai (CN)

(73) Assignee: SHANGHAI XINTANG INDUSTRIAL CO., LTD., Shanghai (CN)

( * ) Notice: Subject to any disclaimer, the term of this patent is extended or adjusted under 35 U.S.C. 154(b) by 0 days.

(21) Appl. No.: 16/495,313

(22) PCT Filed: Jun. 30, 2017

(86) PCT No.: PCT/IB2017/053986
§ 371 (c)(1),
(2) Date: Sep. 18, 2019

(87) PCT Pub. No.: WO2018/172828
PCT Pub. Date: Sep. 27, 2018

(65) Prior Publication Data

US 2020/0016018 A1 Jan. 16, 2020

(30) Foreign Application Priority Data

May 18, 2017 (CN) ..... 201730186421.2
May 26, 2017 (CN) ..... 201720600693.7

(51) Int. Cl.
*A61G 15/00* (2006.01)
*A61H 37/00* (2006.01)
(Continued)

(52) U.S. Cl.
CPC ..... *A61G 15/007* (2013.01); *A47C 4/28* (2013.01); *A47C 9/002* (2013.01); *A47C 9/005* (2013.01);
(Continued)

(58) Field of Classification Search
CPC .... A47C 9/005; A61G 15/002; A61G 15/007; A47B 2200/0096
(Continued)

(56) References Cited

U.S. PATENT DOCUMENTS 5,177,823 A * 1/1993 Riach ..... A47C 7/38 297/408
5,401,078 A * 3/1995 Riach ..... A47C 7/503 297/19
(Continued)

FOREIGN PATENT DOCUMENTS

CA 2429783 A1 * 6/2002 ..... A47C 9/005
CN 2766665 Y 3/2006
(Continued)

OTHER PUBLICATIONS

International Search Report and Written Opinion dated Dec. 25, 2017 in International Application PCT/IB2017/053986.
(Continued)

*Primary Examiner* — Robert Canfield
(74) *Attorney, Agent, or Firm* — Muncy, Geissler, Olds & Lowe, P.C.

(57) ABSTRACT

A foldable massage chair, including a face pillow assembly for supporting the head, a chest pillow assembly for supporting the chest, a handrail assembly for supporting wrists, a front support piece, a seat cushion assembly, a back support rod, a kneeboard assembly, a back supporting frame, and a front supporting frame. When a user needs to use this chair, it is placed in an expanded or use position, so the user may sit on the seat cushion and lean on the massage chair, completely exposing his back, waist, and hips for a masseur to massage. When the chair needs to be put away, it is possible to fold down the chair into a collapsed position by folding the seat cushion assembly, front support piece, chest pillow assembly, and handrail assembly. Also, the front
(Continued)

supporting frame is folded towards the back supporting frame. Consequently, the size of the entire chair decreases.

13 Claims, 19 Drawing Sheets

(51) Int. Cl.

| | |
|---|---|
| ***A47C 4/28*** | (2006.01) |
| ***A61G 15/10*** | (2006.01) |
| ***A61G 15/12*** | (2006.01) |
| ***A47C 9/00*** | (2006.01) |
| ***A61G 13/00*** | (2006.01) |

(52) U.S. Cl.
CPC ..... *A61G 13/009* (2013.01); *A61G 15/002* (2013.01); *A61G 15/10* (2013.01); *A61G 15/125* (2013.01); *A61H 37/00* (2013.01); *A47B 2200/0096* (2013.01); *A61H 2201/0161* (2013.01)

(58) Field of Classification Search
USPC ..... 297/195.11, 423.11, 423.12
See application file for complete search history.

(56) References Cited

U.S. PATENT DOCUMENTS 5,971,485 A * 10/1999 Clark ..... A61G 13/009 297/195.11
6,065,808 A * 5/2000 Tinsley ..... A47C 9/005 297/195.11
6,543,853 B1 * 4/2003 Splane, Jr. ..... A47C 9/005 297/195.11
6,729,690 B2 * 5/2004 Roleder ..... A47C 9/005 297/16.1
6,769,736 B2 * 8/2004 Roleder ..... A47C 9/005 297/195.11
7,144,080 B2 * 12/2006 Lloyd ..... A47C 9/005 297/195.11
D555,794 S * 11/2007 Roleder ..... D24/184
9,205,008 B2 * 12/2015 Meiki ..... A61G 13/009
11,389,005 B2 * 7/2022 Du ..... A47C 7/38
2002/0067060 A1 * 6/2002 Lloyd ..... A47C 9/005 297/195.11
2002/0101108 A1 8/2002 Roleder et al.
2003/0090131 A1 5/2003 Roleder et al.
2005/0035644 A1 2/2005 Lloyd
2017/0273481 A1 * 9/2017 Du ..... A47G 9/1054
2020/0015595 A1 * 1/2020 Du ..... A47C 9/005

FOREIGN PATENT DOCUMENTS

CN 103655109 A 3/2014
WO WO-2011087284 A2 * 7/2011 ..... A47C 9/005
WO WO-2018172828 A1 * 9/2018 ..... A61G 15/002
WO WO-2018172830 A1 * 9/2018 ..... A61G 15/002

OTHER PUBLICATIONS

International Preliminary Report on Patentability mailed Oct. 3, 2019 in International Application PCT/IB2017/053986.

* cited by examiner

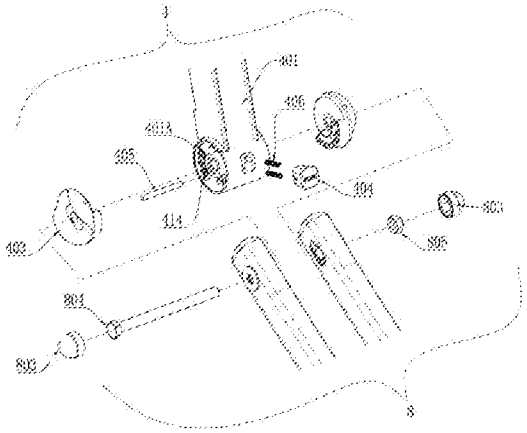
FIG. 21
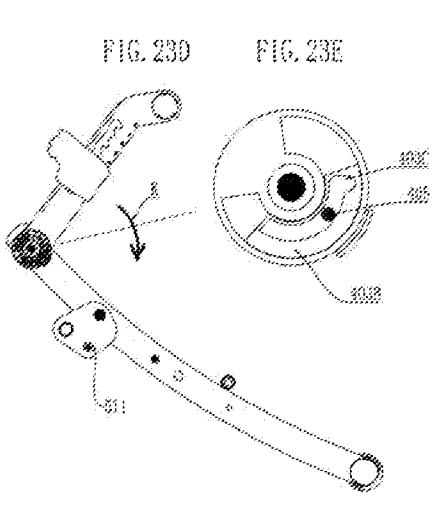
FIG. 23D
FIG. 23E
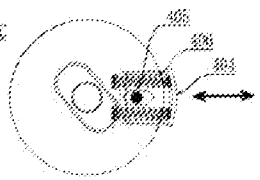
FIG. 23C
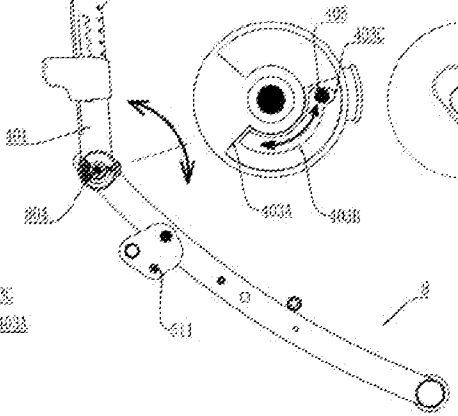
FIG. 23B
FIG. 23A
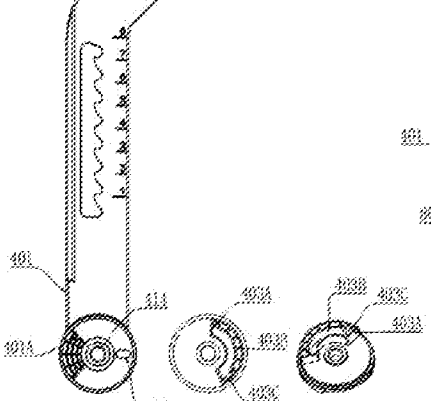
FIG. 22C
FIG. 22B
FIG. 22A

FOLDABLE MASSAGE CHAIR WITH TRIANGULAR SUPPORT CONFIGURATION

CROSS-REFERENCE TO RELATED APPLICATIONS

This application is a national stage application, filed under 35 U.S.C. § 371 of PCT Application No. PCT/IB2017/053986, filed on Jun. 30, 2017, which claims priority to Chinese Application 201720600693.7 filed May 26, 2017 and Chinese 201730186421.2 filed May 18, 2017, which are hereby incorporated by reference in their entireties.

BACKGROUND

Field

This disclosure relates to a massage chair used in the massage therapy field. Specifically, it is a massage chair that is foldable for portability.

Description of Related Art

When people get a back massage, they usually lie on their stomach on a bed. This requires a bed, which occupies certain space. However, using a massage chair can reduce the space occupied.

SUMMARY

It is an aspect of this disclosure to provide a foldable massage chair. The massage chair includes: a face pillow assembly for supporting a user's head, a chest pillow assembly for supporting the user's chest, a handrail assembly for supporting the user's wrists, a front support rod, a seat cushion assembly, a back support rod. a kneeboard assembly, a back supporting frame, and a front supporting frame. Tue face pillow assembly is rotatably connected to the chest pillow assembly. Tue chest pillow assembly is rotatably connected to the front support rod. The handrail assembly is connected on the front support rod. The front support rod is rotatably connected to the back supporting frame. The seat cushion assembly is rotatably connected to the back supporting frame, and the front supporting frame is rotatably connected to the back supporting frame. The massage chair is configured to be moved between an expanded position and a collapsed position. Tue front supporting frame and the back supporting frame are both configured for placement on a surface in the expanded position making the massage chair stable, and the back support rod, the seat cushion assembly, and the back supporting frame are connected to forma triangle for supporting the seat cushion in the expanded position.

Other features and advantages of the present disclosure will become apparent from the following detailed description, the accompanying drawings, and the appended claims.

BRIEF DESCRIPTION OF THE DRAWINGS

FIG. 21 is an exploded view of a second end of the support rod and parts of a back supporting frame to which it is connected in the massage chair of FIG. 2;

FIGS. 22A-22C are side views of parts of the support rod;

FIGS. 23A and 23D are schematics of how to move or rotate the front support rod relative to the supporting frame; FIGS. 23B, 23C and 23E are detailed views of parts in the second end of the support rod;

FIGS. 23C, 23D, and 23E are detailed views of parts in the second end of the support rod;

FIGS. 36 and 37 are schematics showing movement of the parts of the massage chair from its expanded position to its collapsed position, respectively.

DETAILED DESCRIPTION

Disclosed herein is a massage chair used in the massage therapy field. Specifically, it is a foldable massage chair that is easy to carry, install, and fold. Its characteristics conform to the principles of ergonomics. This makes it easier for a masseur to massage people. Also, people will feel more comfortable when using this chair. It is convenient to use the chair.

Figure 1:
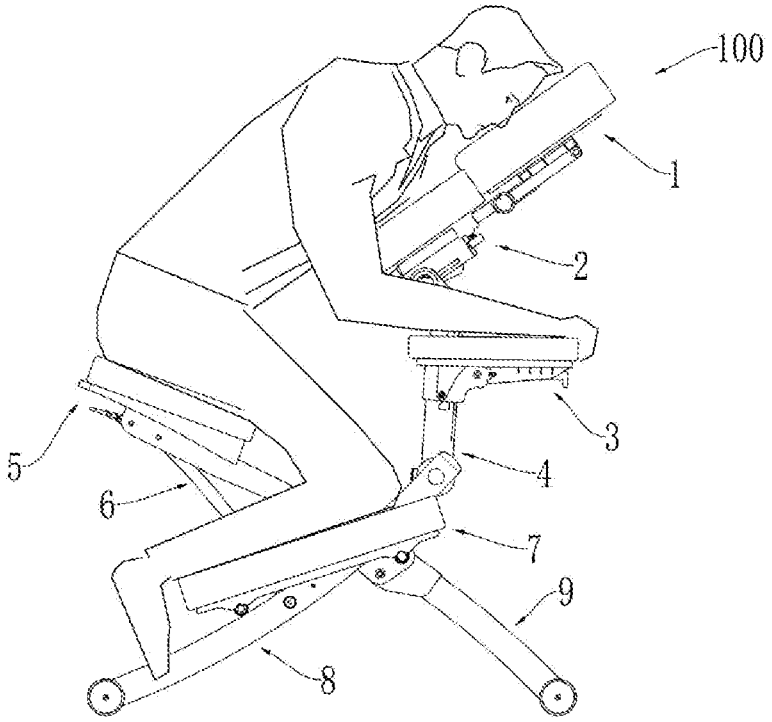
FIG. 1 is a schematic of the disclosed massage chair in use by a person for receiving massage therapy from a massage therapist (masseuse)
Figure 2:
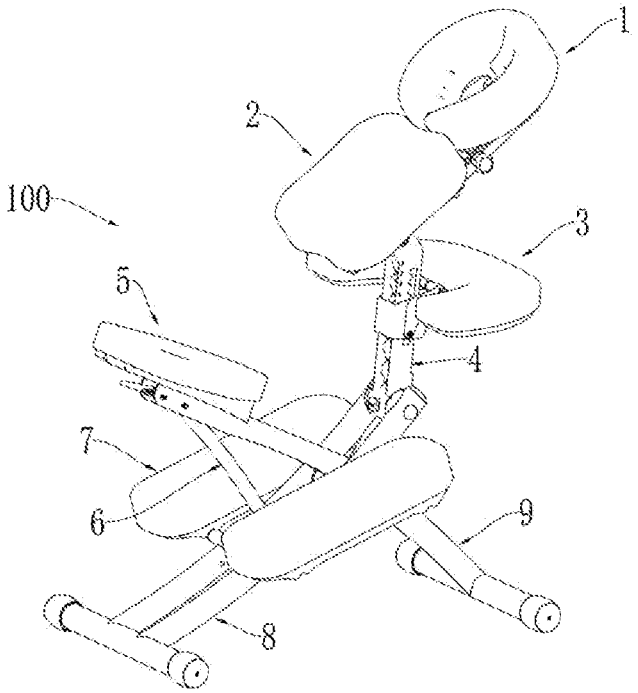
FIG. 2 is a schematic of the massage chair of this disclosure in accordance with an embodiment herein.
Figure 3:
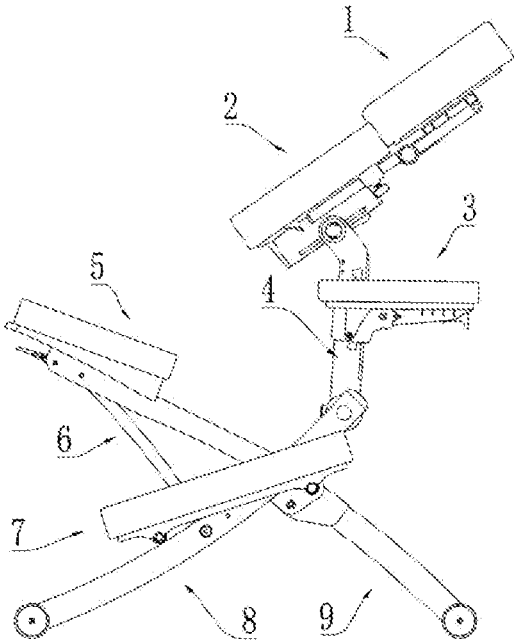
FIG. 3 is a side view of the massage chair of FIG. 2, deployed for use in an expanded position.
Figure 4:
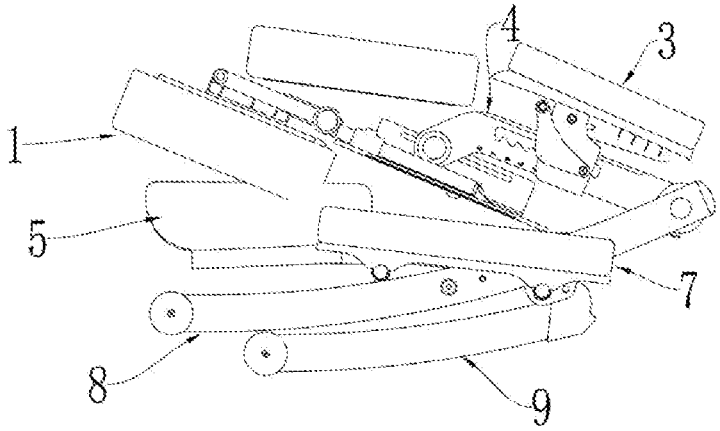
FIG. 4 is a side view of the massage chair of FIG. 2 in a collapsed position.

FIG. 1 shows the herein described massage chair 100 in use by a person positioned on the chair 100 and ready to receive massage therapy from a massage therapist or masseuse or other healthcare professional. Generally, the massage chair 100 includes a face pillow assembly (1) (see also FIG. 2) for supporting a head of a user, a chest pillow assembly (2) supporting a chest of user, a handrail assembly (3) supporting a user's wrists and forearms, a front support rod (4), a seat cushion assembly (5) for a user to place their buttocks for sitting, a back support rod (6) supporting the seat cushion assembly 5, a kneeboard assembly (7) supporting knees and shins of the user, a back supporting frame (8), and a front supporting frame (9). As will be described in greater detail below, the face pillow assembly (1) is rotatably connected to the chest pillow assembly (2), while the chest pillow assembly (2) is rotatably connected to the front support rod (4). The handrail assembly (3) is placed on the support rod (4). The support rod (4) is rotatably connected to the back supporting frame (8). The seat cushion assembly (5) is rotatably connected to the back supporting frame (8). The back support rod (6), the seat cushion assembly (5), and the back supporting frame (8) are connected to form a triangle, as viewed laterally or from the side (e.g., sec FIG. 3) when the massage chair 100 is in its expanded position. This triangular configuration of the back support rod (6), the seat cushion assembly (5), and the back supporting frame (8) supports the seat cushion and the weight of the user placed thereon. The front supporting frame (9) is rotatably connected to the back supporting frame (8), both of which are placed on the ground or floor, making the entire massage chair stable. When a user uses this chair, in its expanded position, as shown in FIG. 1, this user sits on the seat cushion (forwardly, with his/her chest facing towards the frame body) and leans on the massage chair, completely exposing his or her back, waist, and hips and making it easy for a masseur to massage him/her. When the chair needs to be put away, it is moved to a collapsed position, as shown in FIG. 4. As described and illustrated in the later description and drawings. it is possible to fold down the seat cushion assembly 5 and the front support rod 4, and it is possible to move the chest pillow assembly 2 and the handrail assembly 3. Also, it is possible to fold the front supporting frame 9 toward the back. Consequently, the size of the entire chair decreases. Since each of the assemblies is configured to rotate relative to another assembly such that the massage chair 100 may be folded into a collapsed position, such as shown in FIG. 4, it allows for (or increases) portability of the chair 100 such that a user or person can carry the chair 100 to another location and/or store it when not in use.

Figure 5:
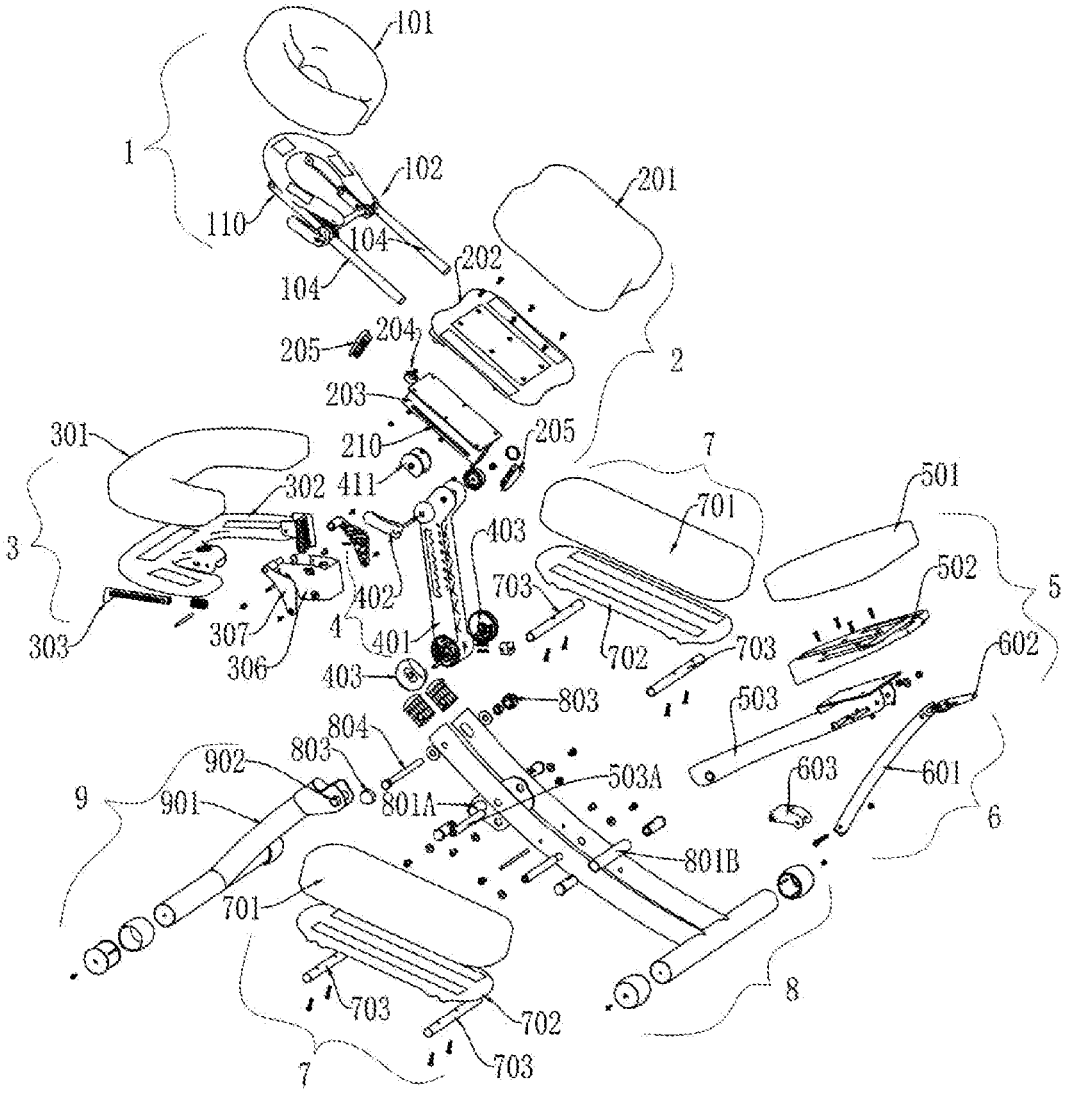
FIG. 5 is an exploded view of the parts of the massage chair of FIG. 2.

FIG. 5 shows an exploded view of the parts used and connected to assemble and form the massage chair 100. A number of fasteners, screws, washers, etc. are shown in FIG. 5 and it should be understood that a number of parts such as these, and others, are provided for securing or locking parts together, although not all of such parts are discussed in detail herein.

Figure 6:
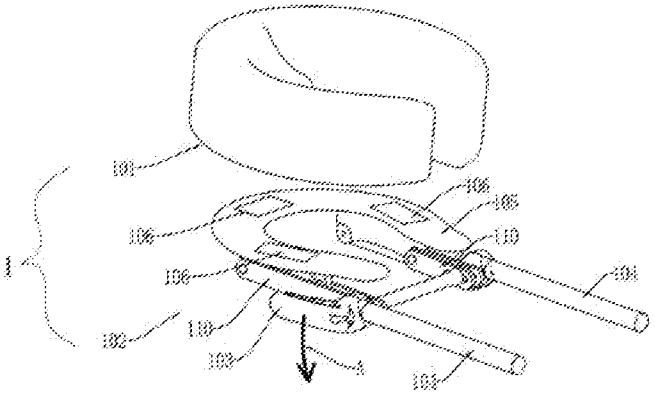
FIG. 6 is a detailed view of parts of a face pillow assembly of the massage chair of FIG. 2.

FIG. 6 shows parts of the face pillow assembly 1 which may include a face pillow (101) and a face pillow frame (102), in accordance with an embodiment. The face pillow frame (102) has a handle (103), two fastening legs (104), and a face pillow plate (105) that are connected by brackets. The face pillow plate 105 may be horseshoe-shaped or U-shaped, for example, or any other suitable shape for a user to position their face and head thereon. A face pillow (101) is placed on and secured to the face pillow plate (105). For example, the face pillow (101) may be attached to the face pillow frame (102) using hook and loop fasteners (a first half of which is generally represented in FIG. 6 as 106, provided on the plate 105) (or Velcro®). In one embodiment, the face pillow (101) may have a similar shape to that of the shape of the face pillow plate 105. In another embodiment, the face pillow (101) may have a different shape as compared to the shape of the face pillow plate 105.

Figure 7C:
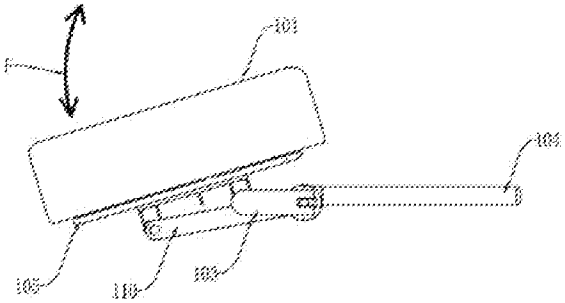
FIGS. 7A, 7B, and 7C are schematics of how to adjust the face pillow assembly of FIG. 6.
Figure 7B:
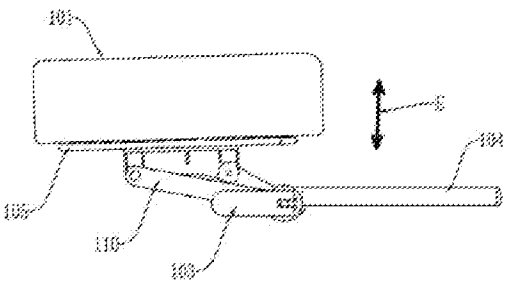
Figure 7A:
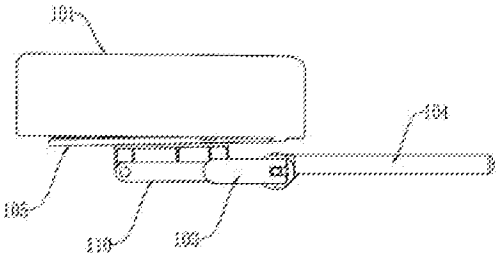

FIGS. 7A, 7B, and 7C show possible adjustments and directions of movement for the face pillow 101's height (see FIG. 7B, arrow E, representing vertical movement) and angle (see FIG. 7C, arrow F, representing rotational movement) by means of the handle 103 and the brackets in the face pillow frame (102). For example, when the handle 103 is loosened, e.g., pulled away from the bracket 110 as shown by arrow A in FIG. 6, the face pillow plate 105 and face pillow 101 may be lifted (see FIG. 7B), or moved in an upward direction relative to the legs 104, by rotating and lifting parts of the bracket 110. Although not depicted in FIG. 7B, the pillow 101 may also be tilted, in accordance with an embodiment. The face pillow plate 105 and face pillow 101 may be lowered and/or tilted (see FIG. 7C), or moved in a downward direction relative to the legs 104, by rotating and lowering parts of the bracket 110. To lock the position of the face pillow assembly 1, the handle 103 may be tightened, e.g., pushed towards the bracket 110.

Figure 8:
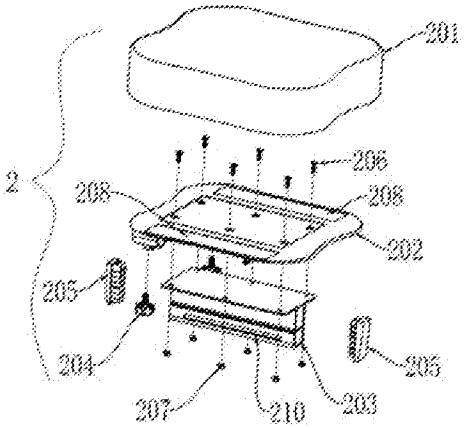
FIG. 8 is a detailed view of parts of a chest pillow assembly of the massage chair of FIG. 2.

FIG. 8 shows parts of the chest pillow assembly 2 which may include a chest pillow (201), a chest pillow board (202), a sliding slot guide rail (203), and at least one knob (204), in accordance with an embodiment. The chest pillow 201 is attached to the chest pillow board (202) by means of hook and loop fasteners (or Velcro®). A slot 208 may be provided on the board 202 for receiving part (e.g., 208) of the hook and loop fasteners, which a matching part being provided on an underside of the chest pillow 201. The chest pillow 201 may be in the form of a spongy cushion, in accordance with an embodiment. The chest pillow board 202 is fastened on the sliding slot guide rail (203) through bolts (206) and nuts (207). The sliding slot guide rail (203) has tube plugs (205) at both ends. Also present on the sliding slot guide rail (203) is a guide slot 210 (see also FIG. 19). Further description regarding use of this guide slot 210 is provided later (e.g., see FIGS. 15A, 19, and 20A-20D).

Figure 9C:
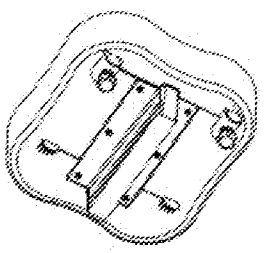
FIGS. 9A, 9B, and 9C are schematics showing an underside of the chest pillow assembly of FIG. 8.
Figure 9B:
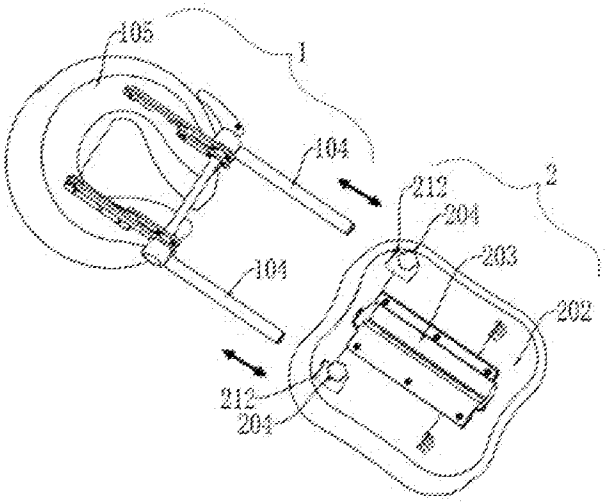
Figure 9A:
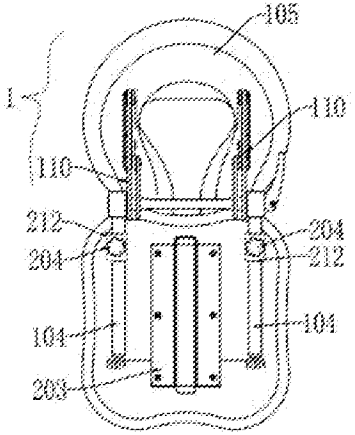

As shown in the underside views of FIGS. 9A-9C, and particular in FIG. 9B, there are two knobs 204 each respectively connected to a tubular portion 212 provided on the bottom of the chest pillow board 202. For example, the knobs 204 may include a screw portion extending therefrom that is inserted and rotated within a corresponding receiving opening of the tubular portions 212. The tubular portions 212 are secured such that they are spaced with a distance therebetween. In one embodiment, the distance between the tubular portion 212 may be based on, or correspond to, spacing of the fastening legs 104, such that the legs 104 slide into the tubular portion 212. The face pillow assembly 1 is able to moves freely and is easy to install and remove.

Figure 10A:
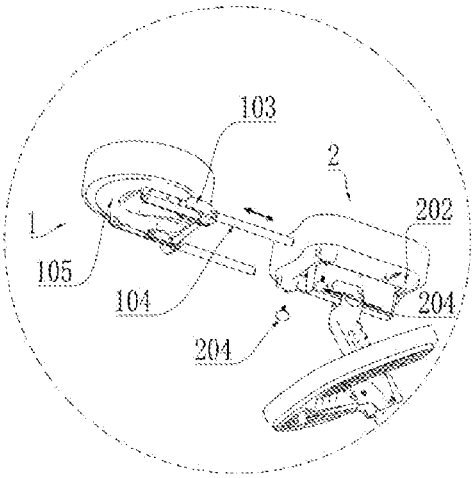
FIGS. 10A and 10B are schematics of how to install the face pillow assembly of FIG. 6 to the chest assembly of FIG. 8.
Figure 10B:
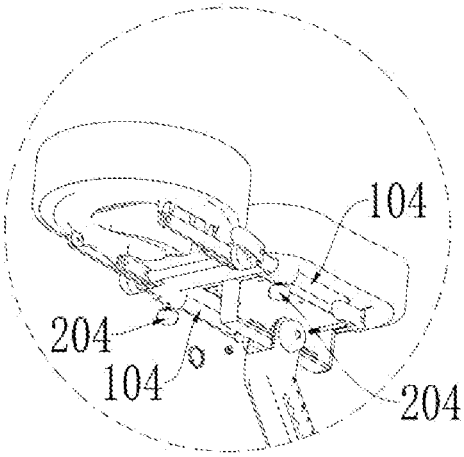
Figure 15A:
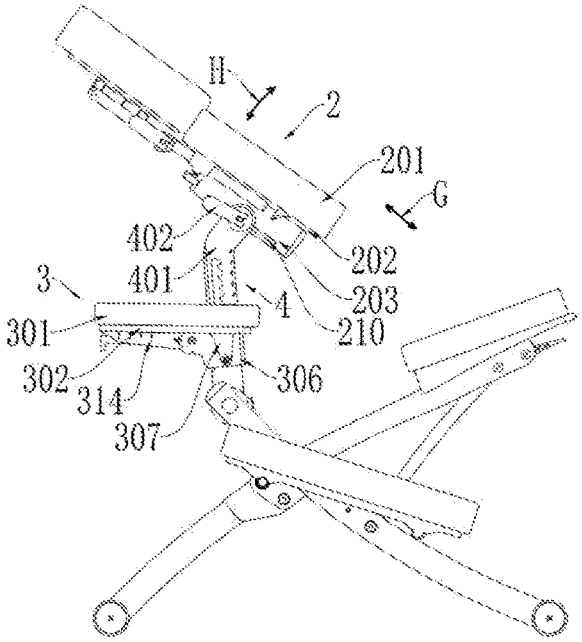
FIGS. 15A, 15B, and 15C are schematics of how to adjust the handrail assembly and support rod.

FIGS. 10A and 10B show schematics of installing and securing the face pillow assembly 1 to the chest assembly 2. The fastening legs (104) are aligned with openings of the tubular portions 212 and inserted through, and positioned against the chest pillow plate (202). Each of the knobs 204 may be rotated (e.g., clockwise) to move ends of their screw portions against the legs 104, thereby fastening the face pillow assembly (1) on the chest pillow assembly (2). In contrast, when the knob (204) is loosened (e.g., rotated counter-clockwise), it is possible to move legs 104 of the face pillow frame 102 along with its pillow 201 (see FIG. 11) back and forth within the tubular portions 212 (towards a back or front of the massage chair 100, as shown in FIG. 15A) to adjust its position relative to the chest pillow 201 of the chest pillow assembly 2. Again, knobs 204 may be used to secure the pillow 201 at the desired distance relative to the chest pillow 201 by tightening them such that they engage the legs 104. As described above with reference to FIGS. 7A-7C, when the handle (103) is loosened, it is possible to move the face pillow plate 15 around the fastening leg (104) to adjust the position thereof relative to the chest assembly 2.

Figure 13:
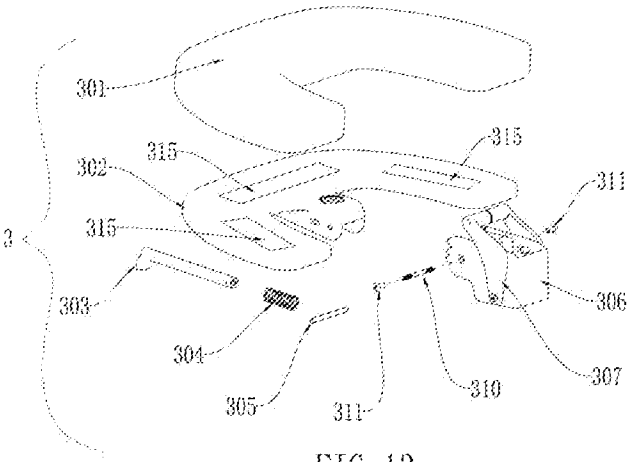
FIG. 13 is an exploded view of the parts of handrail assembly of the massage chair of FIG. 2.
Figure 12:
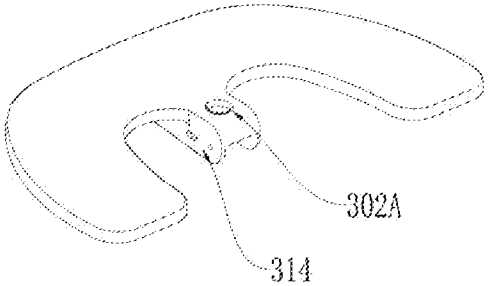
FIG. 12 is a schematic of a plate used in a handrail assembly of the massage chair of FIG. 2.
Figure 14D:
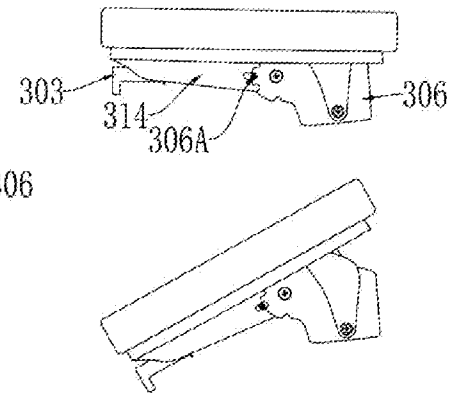
FIGS. 14A-14E are schematics of how to adjust the handrail assembly in one manner.
Figure 14B:
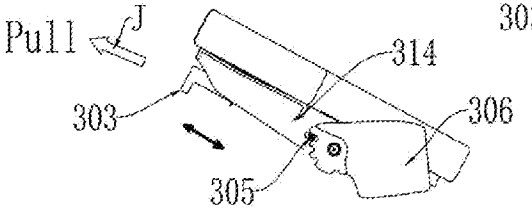
Figure 14A:
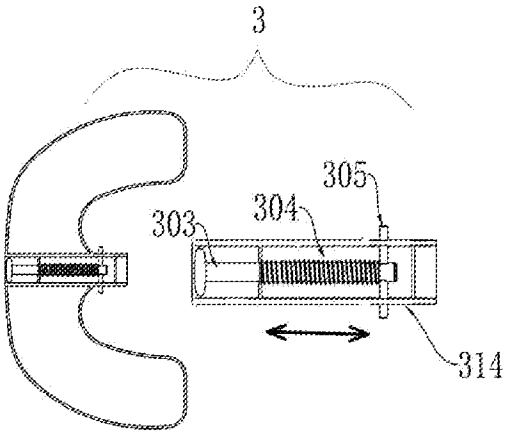
Figure 14C:
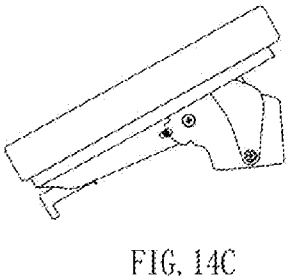
Figure 14E:
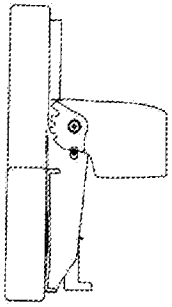
Figure 18:
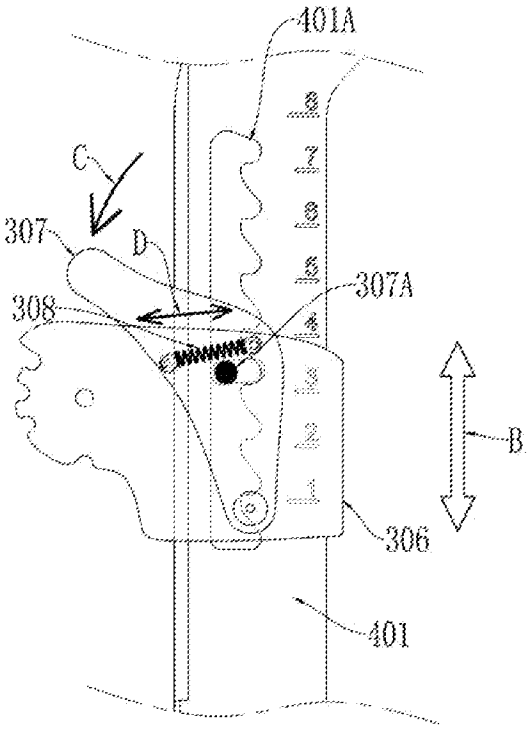
FIG. 18 is a schematic showing vertical movement of the parts of FIG. 17.

Parts of handrail assembly 1 of the massage chair 100 are shown in FIG. 13. The handrail assembly may include a handrail cushion (301), a handrail plate (302) (see also FIG. 12), a handle (303), a compression spring (304), an axis pin (305), a fastener (306), another handle (307), and another compression spring (308). FIG. 18 is an underside view of the parts of handrail assembly 3 when assembled in the massage chair 100. The handrail spongy cushion (301) may be attached to the handrail plate (302) by means of hook and loop fasteners (a first half of which is generally represented in FIG. 13 as 315, provided on the plate 302) (or Velcro®). As shown in FIG. 12, there may be an essential oil container (302A) provided on the handrail plate (302), for receiving essential oils during a massage, to provide comfort to the user. Underneath the handrail plate (302) is installed a handle (303), shown in FIG. 14A. The handle (303) goes through a frame portion 314 of the handrail plate (302), and a compression spring (304) and an axis pin (305) are installed on the handle 302. By pulling the handle 303, e.g., outwardly relative to the frame portion 314 as shown by arrow J in FIG. 14B, the handrail plate 302 and handrail cushion 301 may be configured for rotation axially relative to fastener 306, as shown in FIG. 14C, for example. More specifically, pulling of the handle 303 outwardly results in the axis pin 305 being moved out and separating from a slot 306A in a gear-shaped clamp 313 provided on the handrail fastener (306), thereby permitting rotation of and adjustment of the angle of the handrail plate 302, e.g., by rotating the plate 302 relative to the fastener 306 which is rotatably connected to support rod 4 of the massage chair 100 (see arrow B2 in FIG. 15B, and also FIG. 15A). The compression spring 304 pulls the handle 303 back into the frame portion 314.

Figure 15B:
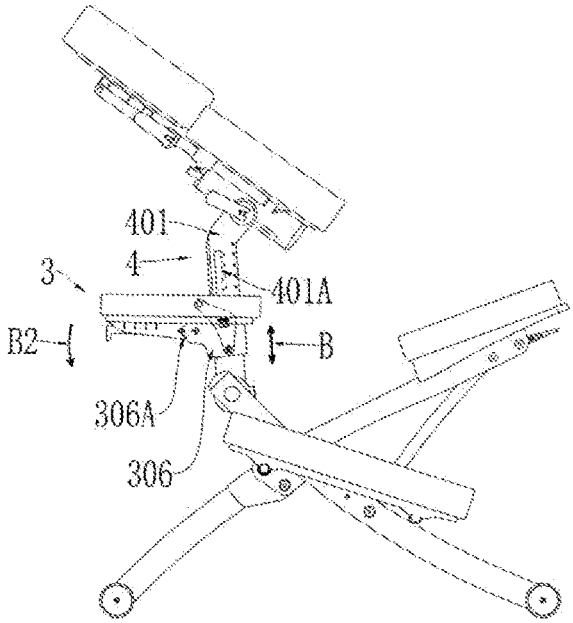
Figure 15C:
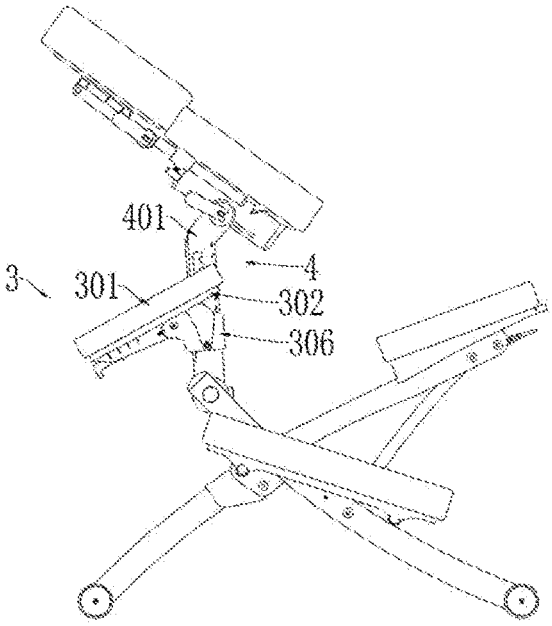
Figure 16:
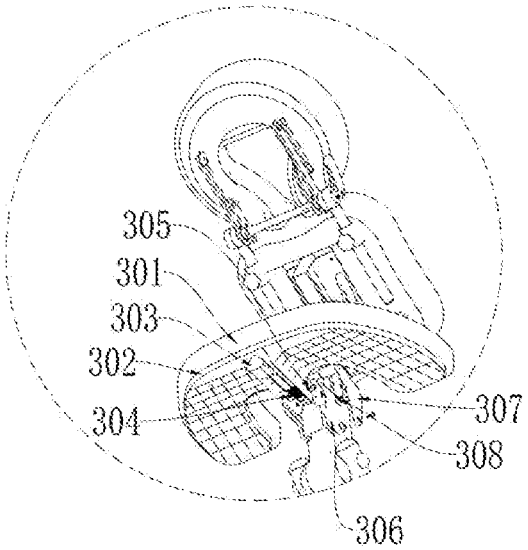
FIG. 16 is an underside view of the handrail assembly parts of the massage chair.
Figure 17:
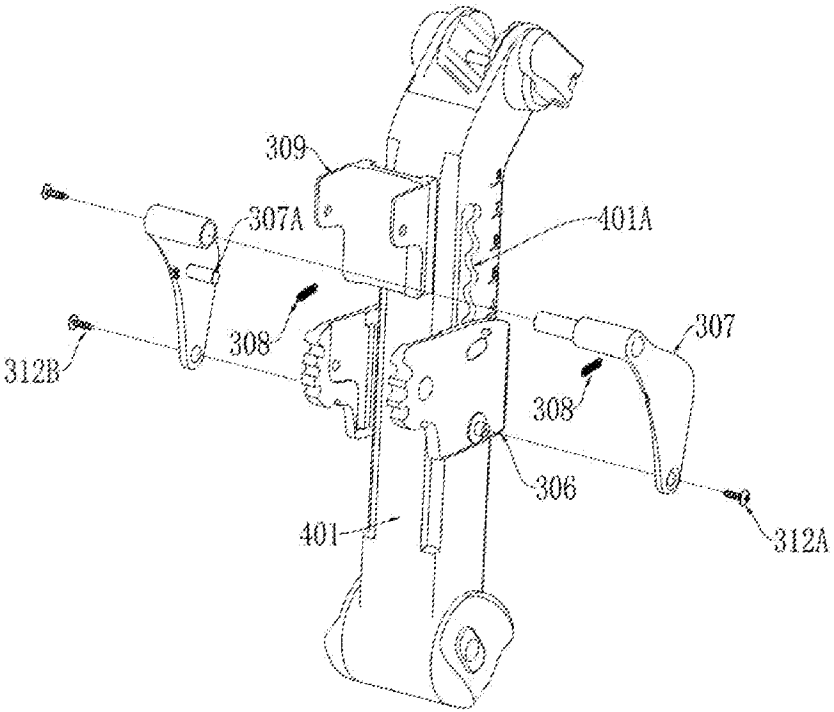
FIG. 17 is an exploded view of parts of a support rod and handrail assembly of the massage chair of FIG. 2.

As shown in FIGS. 15A-15C, the fastener 306 of the handrail assembly 3 goes through a front upright post (401) of the support rod 4 of the massage chair 100. FIG. 17 shows in more detail the handrail fastener (306), a handle (307), extension springs (308), a clamp inside handrail fastener (309), and screws (312) of the handrail assembly 3 which are connected together relative to the front support rod 401. A handle (307) (see also FIG. 13) is installed on the handrail fastener (306), and an extension spring (308) and a round retaining pin (307A) are installed inside the handle (307). The handle (307) is fastened by means of screws 312A and 312B, and it is possible to move the handle 307 around for adjustment of the handrail assembly 3, as explained further below with reference to FIG. 18.

In the massage chair 100, the upright post 401 extends in a generally vertical direction. There is a saw-toothed slot (401A) on the upright post 401 which allows the handrail fastener (306) to move vertically up and down along the rod 401, as represented by arrow B in FIG. 18. Teeth in the saw-toothed slot 401A are designed to face in an upward direction so that each tooth can receive the round retaining pin 307A of handle therein, without it easily falling away from the tooth and into a groove of the slot 401A. For example, when the handle (307) is pressed or pulled outwardly away from the upright post 401, as represented by arrow C in FIG. 18, the retaining pin 307A on the handle (307) separates from the teeth of the saw-toothed slot 401A (see arrow D) and moves into the groove in the slot 401A. The handrail assembly (3) is permitted to move up and down freely relative to the upright post 401 to a number of positions, e.g., positions 1 through 8 are generally shown as an example in FIG. 17. To lock the handrail assembly 3 in a desired position, the handle 307 is released and the retaining pin 307A moves from the groove and into one of the teeth of the saw-toothed slot 401A.

When needed, the handrail assembly 3 may be moved up without pressing the handle (307), and instead by handle 303, as described previously and shown in FIGS. 14B and 14C.

Figure 19:
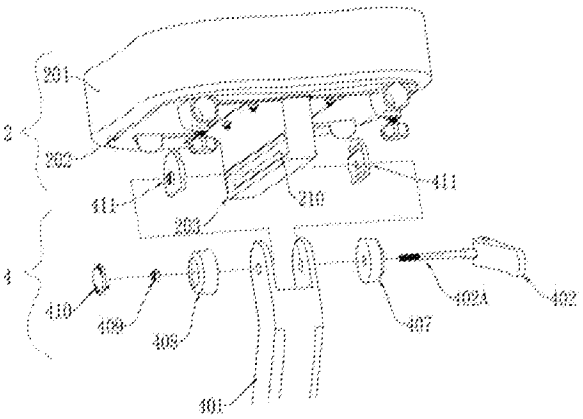
FIG. 19 is an exploded view of parts of the chest pillow assembly and first end of front support rod that are connected to each other in the massage chair of FIG. 2.

FIG. 19 shows parts used to connect the chest pillow assembly 2 at a first (upper) end of the upright post 401 of the support rod 4. Upright post 401 may include a quick release handle (402), a plastic cover (407), a nut cover (408), a nut (409), a hole cover (410), and rotation plastic parts (411) installed on it. As previously noted, a sliding slot or guide slot 210 is provided on the chest pillow sliding slot guide rail (203). The guide rail 203 is inserted into an opening between flange portions at the first (upper) end of the upright post 401, and is flanked on either side by rotation plastic parts 411 (see FIGS. 20B and 20C). The rotation plastic parts 411 each have a central opening with a connector portion extending from an outer side thereof, that are aligned with and inserted into holes in the flange portions of the upright post 401. In an embodiment, the outer sides of the guide rail 203 include linear protrusions that are aligned within corresponding channels provided on an inner side of the rotation plastic parts 411 (see FIG. 20C).

The handle (402) is set up on the upper end of the upright post (401), through the guide slot 210 of the chest pillow sliding slot guide rail (203). An axis pin 402A extending from handle 402 is inserted through a hole in plastic cover 407. Plastic cover 401 is provided on an outer side of a flange portion of the upright post 401. The axis pin 402A is further inserted through the hole in the flange portion, through guide slot 210 of the guide rail 203, and through the hole on the other flange portion of the post 401. A nut 409 is connected to the end of the axis pin 402A and tightened to secure the handle 402 on the upright post 401. A nut cover 408 and a hole cover 410 (connected to the nut cover 408) may be attached to cover the end of the pin 402A and nut 409.

Figure 11:
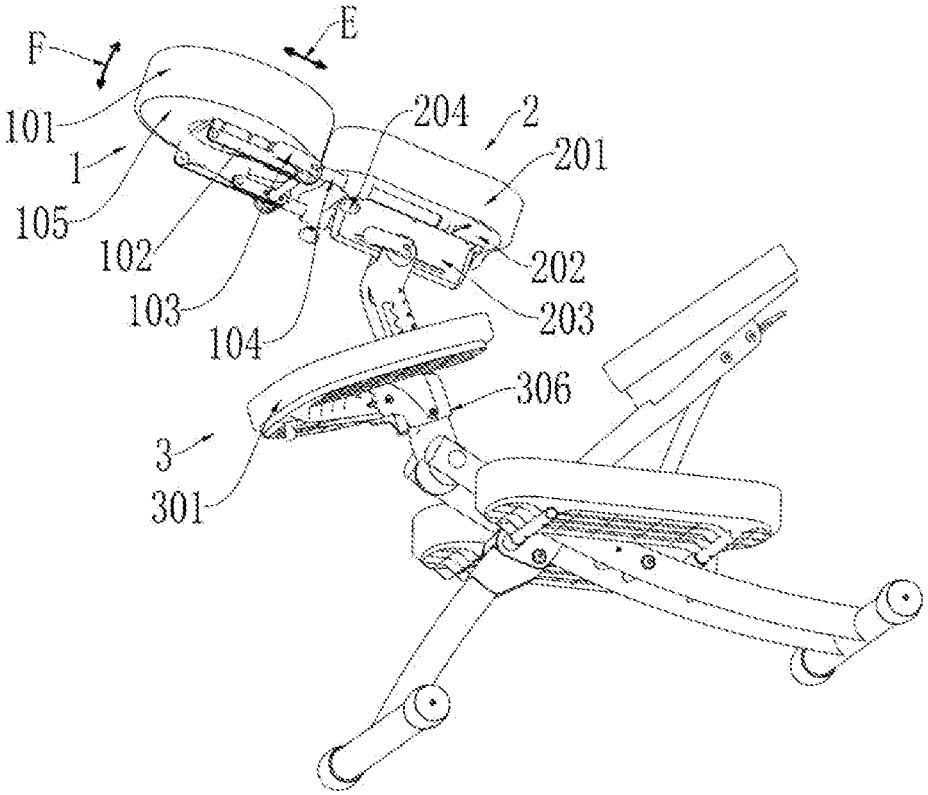
FIG. 11 is a schematic of how to adjust the face pillow assembly relative to the chest assembly of the massage chair of FIG. 2.
Figure 20C:
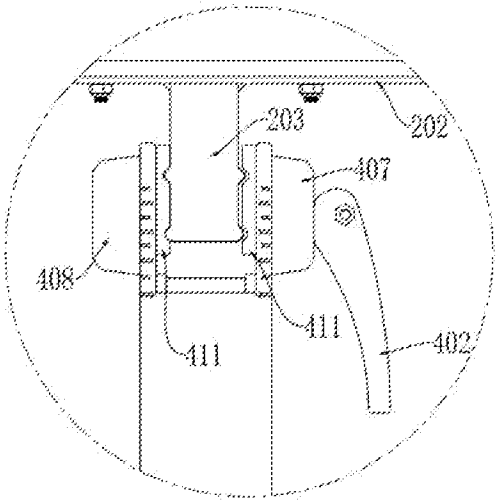
FIGS. 20B and 20C show the assembly of the chest pillow assembly in the support rod, FIG. 20C showing a detail of FIG. 20B.
Figure 20D:
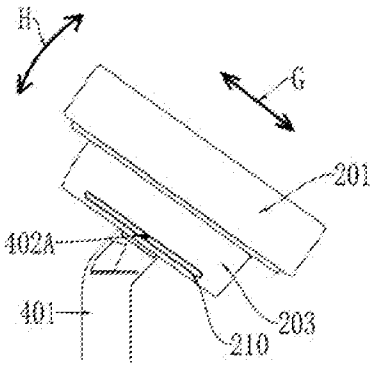
FIGS. 20A and 20D are schematics of how to adjust the chest pillow assembly relative to the front support rod.
Figure 20B:
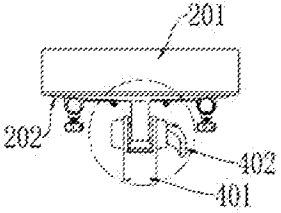
Figure 20A:
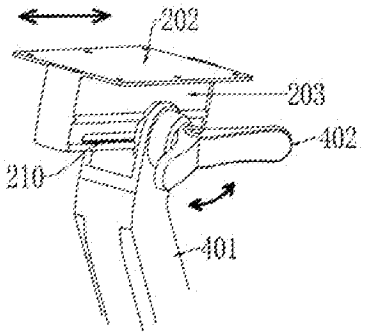

To adjust the chest pillow 201 of the chest pillow assembly 2 relative to the support rod 4, the handle 402 may be loosened, e.g., moved or flipped back and forth between locked and unlocked positions, such as shown in FIG. 20A. It is then possible to move the chest pillow plate 202 back and forth (see, e.g., arrow G in FIG. 20D) relative to the first (upper) end of the upright post 401 (towards a back or front of the massage chair 100, as seen in FIG. 11) by moving the guide rail 203 and its slot 210 (the slot 210 is guided along and relative to the pin 402A). It is also possible to rotate the chest pillow plate 202 and chest pillow 201 around the upright post (401), as shown by arrow H.

FIG. 21 is an exploded view of parts of a second (bottom) end of the support rod 4 for connecting to an end of the supporting frame 8. Fasteners (403), a button (404), an axis pin (405), and a compression spring (406) are provided in the second end of the post 401. As shown in greater detail in FIG. 22, there is spacing (401A) on the upright post (401), and there is corresponding portion (403A) set up on the fastener (403), protruding from the body of the fastener 403, for example. The spacing 401A may be configured to receive corresponding portion 403A therein, in accordance with an embodiment. Specifically, the corresponding portion 403A of each fastener 403 is inserted into the spacing 401A of the post 401. Accordingly, the alignment and insertion of the corresponding portion 403A into spacing 401 restricts the upright post's (401) counterclockwise rotation (relative to the supporting frame 8). Once the front support rod has been turned to the use position, the spacing on the fastener and the front support rod restrict movement of the front support rod. At the same time, the button comes out through the compression spring, while the axis pin enters a slot in the fastener; consequently, the front support rod is fastened at the use position; and when folding chair, simply pressing the button disengages the axis pin from the slot, allowing movement of the front support rod to the rear. Although FIG. 22 shows only one side of the upright post 401, it should be understood that the opposite side of the post 401 has similar spacing 401A, e.g., to receive corresponding portion 403A of the fastener 403 on the other side.

A button (404) and an axis pin (405) are set up on the upright post (401). The button and pin are used to control rotation of the upright post 401, as explained below. To assemble the button 404 to the post 401, the axis pin 405 is inserted through a slot 416 (see FIG. 22) at the second (bottom) end of the upright post 401. The axis pin 405 goes further through openings in the button (404). Each fastener 403 may also have a slot 403B therein, e.g., provided in the corresponding portion 403A, configured to receive an end of the axis pin 405.

Figure 24:
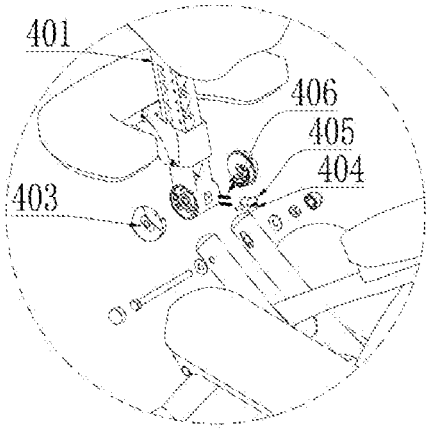
FIG. 24 is a schematic of how to install the front support rod to the supporting frame.

To assemble the support rod 4 to the back supporting frame 8 (see, e.g., FIG. 24), the second end of the post 401 is inserted between leg portions at an (upper) end of the supporting frame 8, and is flanked on either side by fasteners (403) (see FIG. 21). Through openings in the fasteners (403), the upright post (401) is connected to the back supporting frame (8) by means of a bolt (804). The bolt 804 is inserted through a hole of one leg portion, through the opening of one fastener 403, through slot 414 of upright post 401, through the opening of the other fastener 403 and then hole of the second leg portion, as secured using a nut 805. Covers 803 may be provided over the bolt head and nut 805. By using the bolt (804) as the axis, the upright post (401) is configured to move (rotate) around relative to the back supporting frame 8, as shown in FIG. 23A.

Figure 25A:
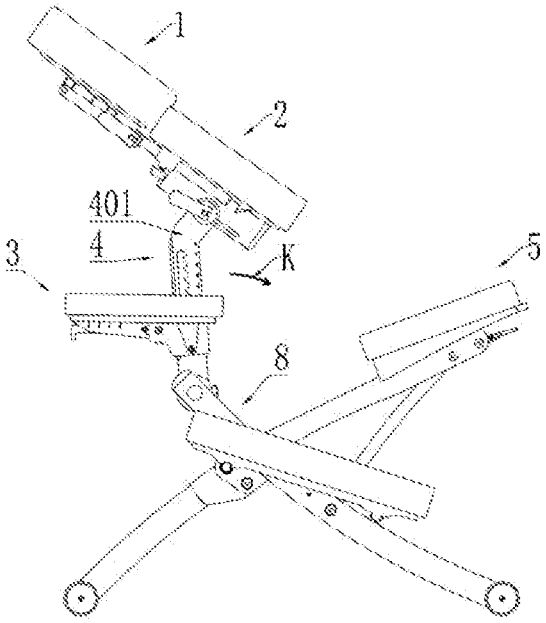
FIGS. 25A and 25B are schematics of how to fold the front support rod when the massage chair is moved into a collapsed position.
Figure 25B:
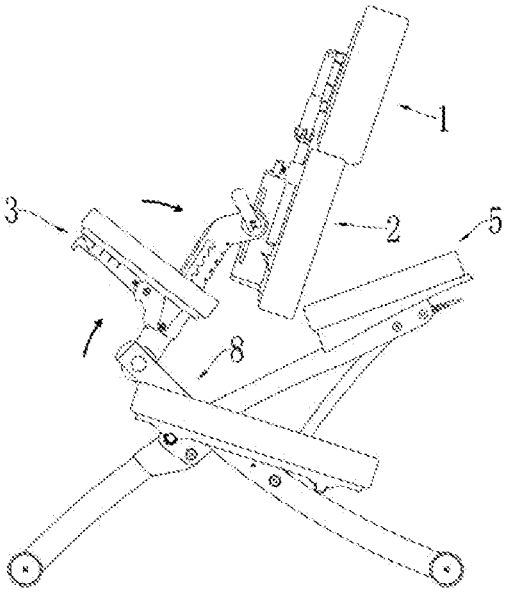

FIGS. 23C, 23D, and 23E show in greater detail movement of the axis pin 405 within the second end of the upright post 401. The upright post (401) may move around relative to the frame 8, thereby moving the pin 405 within the slot 403B of the fasteners 403. When the upright post (401) rotates to the use position, shown in FIG. 23A, for example, the axis pin (405) turns through the slot (403B) (see FIG. 23C) and enters an end slot 403C of the slot 403B. The spacing 401A on the fastener (403) and 403A of the upright post 401 restrict movement of the support rod. Consequently, the support rod is fastened at the use position. The compression spring (406) decompresses and pushes the button 404 outward, as shown in FIG. 23D. As a result of entering the end portion 403 of the slot 403B, rotation of the upright post 401 is restricted. When folding the massage chair 100 to its collapsed positon, the button 404 may be pressed (inwardly) to disengage the axis pin 405 from the end slot 403C, allowing movement of the pin 405 through the slot 403B, as shown in FIG. 23B, and thus allowing rotation of the upright post 401 relative to the back supporting frame 8, e.g., towards the frame as shown by arrow K. FIGS. 25A and 25B show how the front support rod 4 folds towards a front of the massage chair 100 (and closer towards back supporting frame 8), when the massage chair is moved into its collapsed position.

Figure 26:
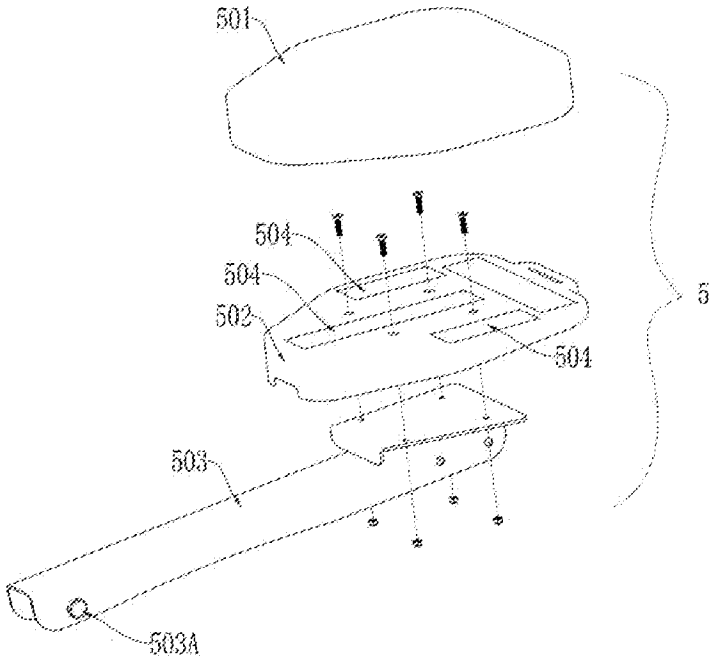
FIG. 26 is an exploded view of parts of a seat cushion assembly of the massage chair of FIG. 2.

FIG. 26 shows parts of seat cushion assembly 5 of the massage chair 100. The seat cushion assembly (5) includes a seat cushion (501), a seat cushion fastening base plate (502), and a seat cushion support rod or support arm (503). The seat cushion 501 may be formed from a spongy cushion material, for example. The seat cushion (501) is attached to the base plate (502) by means of hook and loop fasteners (a first half of which is generally represented in FIG. 26 as 504) (or Velcro®). The base plate (502) is fastened on the support arm (503) by means of bolts and nuts or screws or other similar fasteners. The support arm 503 may have a general "U" shape or channel therein. The support arm 503 is attached to the back supporting frame 8 by aligning the arm 503 relative to the leg portions of the frame 8 and inserting axle rod 503A through aligned holes in the arm 503 and legs of the back supporting frame 8 and securing it to a bracket portion 511 via fasteners such as bolt(s) and/or nut(s). The seat cushion support arm (503) can rotate around 503A with 503A as the center, as shown by arrow M in FIG. 27.

Figure 27:
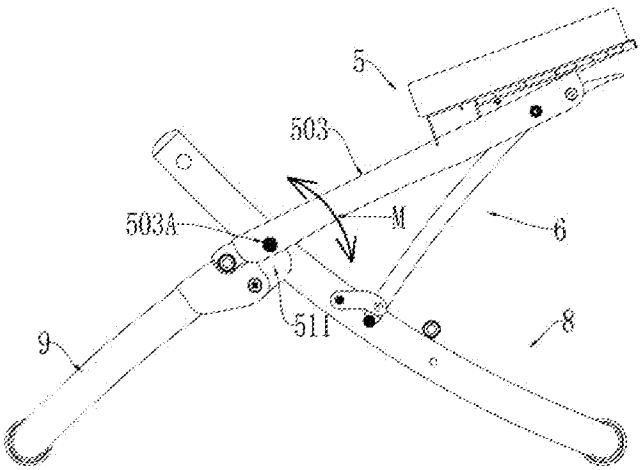
FIG. 27 is a schematic of how the seat cushion assembly moves relative to the supporting frame.
Figures 28, 29:
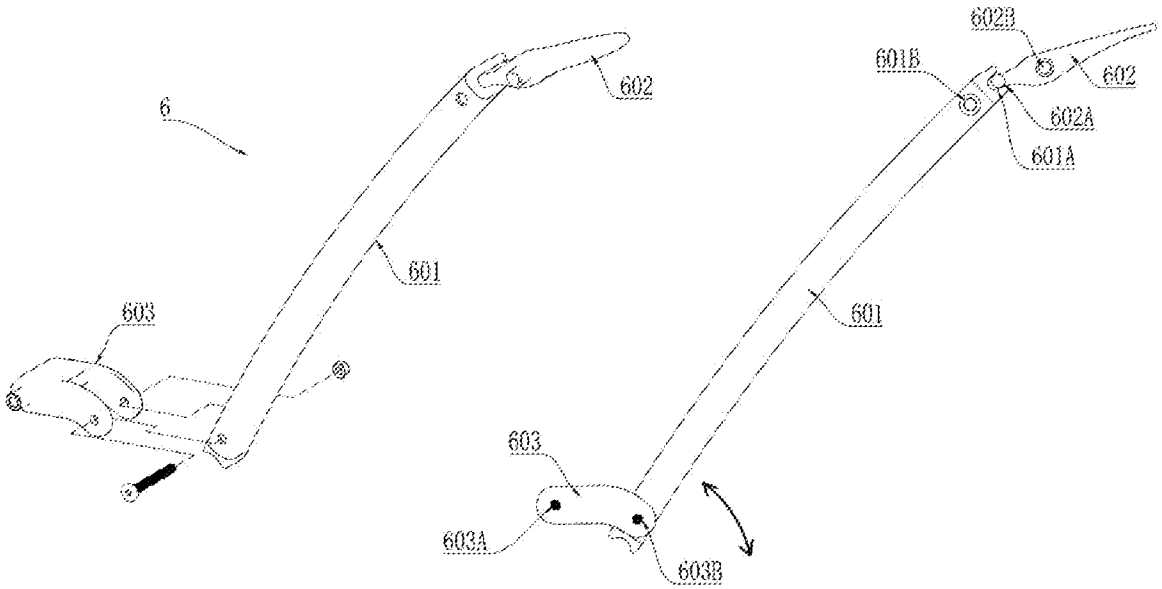
FIGS. 28 and 29 show parts of a back support rod used with the seat cushion assembly in the massage chair of FIG. 2.

Connected to the seat cushion assembly 5 and back supporting frame 8 is the back support rod 6. As shown in FIG. 27, the back support rod 6, the seat cushion assembly 5, and the back supporting frame 8 are connected to form a triangle in the extended position of the massage chair, which supports the seat cushion 501. FIGS. 28 and 29 show parts of the back support rod 6 in greater detail. Back support rod (6) includes a back support rod (601), a handle (602), and a rotation piece 603 which act as a support structure for the seat cushion 510. There is a U-shaped slot (601A) on an end of the support rod as shown in FIG. 29, and there is a touch point (602A) on the front end of the handle 602 which is inserted into the slot 601A. The seat cushion support rod (503) forms a rotatable connection with the back supporting frame (8), while the back support rod (601) and the rotation piece form a rotatable connection with the seat cushion support rod (503) and the back supporting frame (8), respectively.

The ends of the seat cushion assembly 5 and back support rod 6 are configured to rotate relative to the leg portions of the back support frame 8 as generally indicated by arrow M.

Figure 30C:
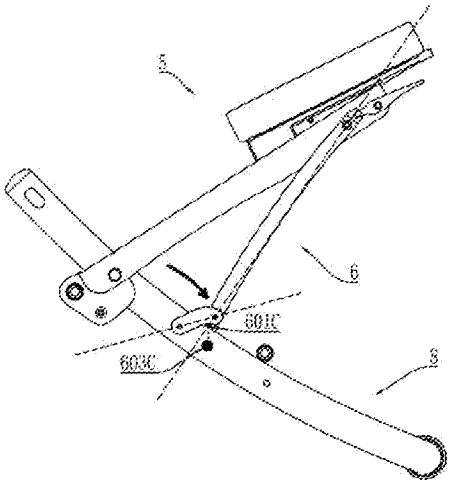
FIGS. 30A, 30B, and 30C are schematics of the movement of seat cushion assembly and back support rod of the massage chair in an extreme position, folding into its collapsed position, and unfolding into its expanded position, respectively.
Figure 30B:
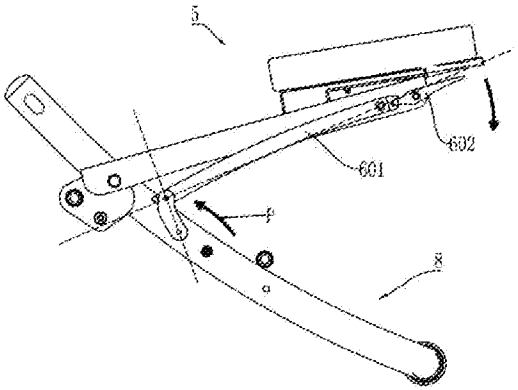
Figure 30A:
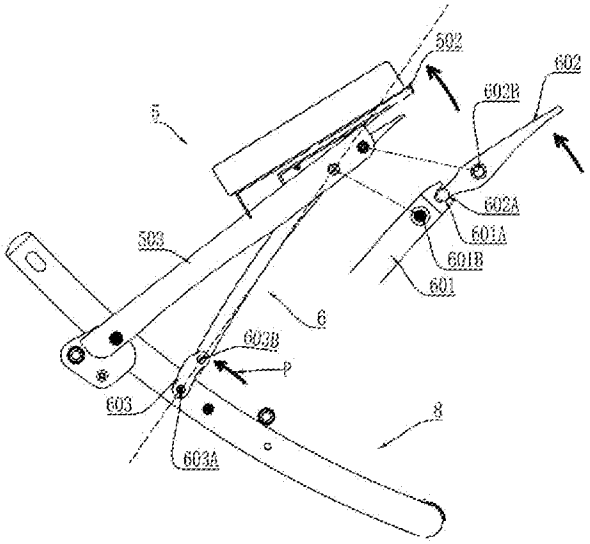

FIGS. 30A, 30B, and 30C illustrate relative movements of parts of seat cushion assembly 5 and back support rod 6 of the massage chair 100. In particular, FIGS. 30A and 30B show movements of these parts for moving from an expanded position towards the collapsed position, whereas FIG. 30C shows movement from the folded or collapsed position into the expanded (or in-use) position.

FIG. 30A shows the seat cushion assembly 5 rotated into an extreme (most upright) position, relative to supporting frame 8. If the seat cushion assembly (5) is raised, then the back support rod can go beyond the extreme point due to gravity, elastic force, and the like by moving the handle (602) upward when the back support rod (601) and the rotation piece (603) reach the extreme point. The rotating part (603) can rotate around the axis (603A), while the base plate support rod (601) and the rotating part (603) can rotate around the axis (603B). The base plate support rod (601) can rotate around the axis (6018), while the handle (602) can rotate around the axis (602B). Raising the base plate (502) pulls the base plate support rod (601). When the support rod is pulled to the maximum level, 603A, 603B, and 601B form a straight line. At that moment, when a user pulls the handle (602) upward, and the handle (602) will rotate around the axis (602B) in a counterclockwise manner. Through driving motion, the handle's touch point (602A) will drive the base plate support rod (601A) to rotate around the axis (601B) in a clockwise manner. Consequently, the rod 601 pulls the rotating part 603 around axis 603A, as represented by arrow Pin FIGS. 30A and 30B, and the axis (603B) will pass through the limit point, and the rotating part (603) will form an included angle with the base plate support rod (601).

FIG. 30B shows movement of the seat assembly 5 and back support rod 6 towards the supporting frame 8, after movement into its extreme position, as the massage chair is folding into its collapsed position. The base plate (502) is put down or moved in in a clockwise manner so that the bottom (601C) of the base plate support rod (601) forms a stable triangle on the axis (603C) to support the base plate assembly (5) while folding together with the leg portions of the back supporting frame 8. When the seat cushion assembly (5) is lowered, the back support rod (601) is supported by the back supporting frame (8).

Conversely, when the chair is being unfolded into its expanded position, as shown in FIG. 30C, the seat cushion assembly (5) reaches the use position, as shown in FIGS. 1-3 and 27, for example. When the base plate assembly (5) is folded, the base plate (502) is raised, which will lead to rotation of the base plate support rod (601). When the base plate is raised to its maximum level, the base plate support rod (601) makes the base plate 502 rotate in a counterclockwise manner due to gravity. When the support rod goes beyond the limit point, the rotating part (603) will form an included angle with the base plate support rod (601). The base plate (502) is then put or moved downward in a clockwise manner so that the bottom (601C) of the base plate support rod (601) forms a stable triangle on the axis (603C) to support the base plate assembly (5) along with back supporting frame 8.

Figure 32:
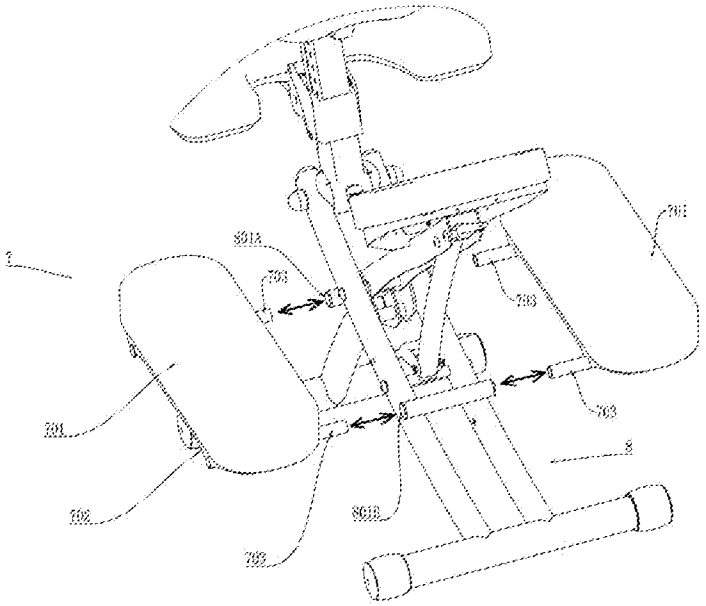
FIG. 32 is a schematic of how to remove and attach the kneeboard assembly to the back supporting frame of the massage chair of FIG. 2.
Figure 31:
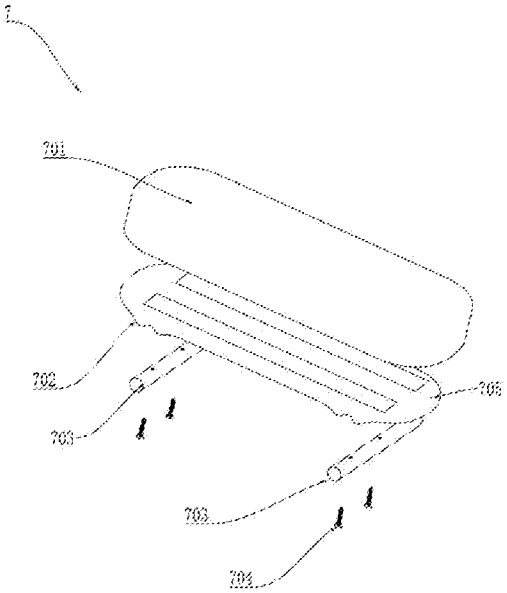
FIG. 31 is a schematic of parts forming the kneeboard assembly.

Two kneeboard assemblies 7 are also provided on the massage chair 100. As shown in FIG. 31, for each assembly 7, a knee pillow (701) is attached to a kneeboard (702) by means of hook and loop fasteners (a first half of which is generally represented in FIG. 31 as 705) (or Velcro®). The knee pillow 701 may be in the form of a spongy cushion. Two connecting tubes (703) are fastened on the kneeboard (702) by means of bolts (704) or screws or similar fasteners. The connecting tubes 703 are used to attached the kneeboard assemblies 7 to the back supporting frame 8, and are easy to install. As shown in FIG. 32, fastening tubes 801A and 801B are provided on the supporting frame (8). The connecting tube (703) is aligned with and runs through the fastening tubes 801A, 801B on the back supporting frame (8). When a user needs to use the kneeboard, the connecting tubes (703) are inserted through the fastening tubes on the supporting frame (8) to support the kneeboard. In addition, the kneeboard may be readily removed manually when not needed.

Figure 33:
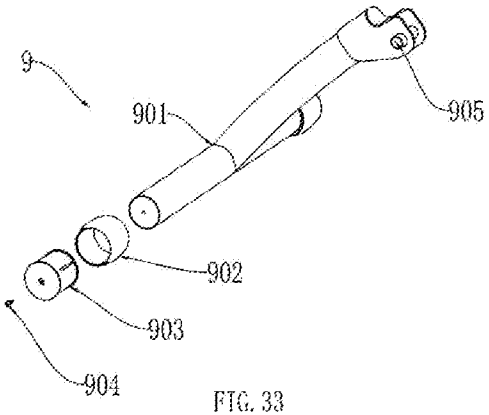
FIG. 33 is a schematic of parts of a front supporting frame of the massage chair of FIG. 2.

Further, the supporting frame (8) has a rotatable connection with the front supporting frame (9) of the massage chair 100. FIG. 33 illustrates parts of the front supporting frame 9. The frame 901 is generally T-shaped. A pin 905 is used to attach a top portion of the frame 901 to the back support frame 8. On either end of a floor contacting portion, a foot tube external cover (902) is placed outside the foot tube internal cover (903), and it is fastened on the ends of the front supporting frame (901) by means of a screw (904).

Figure 35:
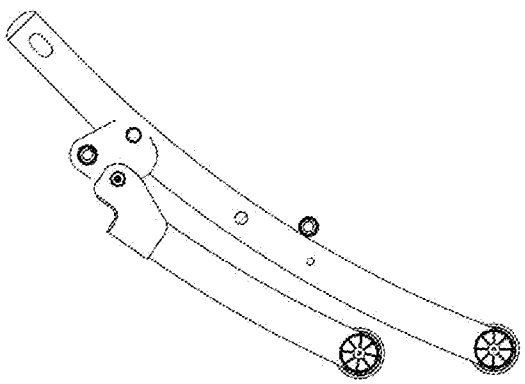
FIGS. 34 and 35 show positioning of the front supporting frame and the back supporting frame when the massage chair of FIG. 2 is in its expanded/in-use position and collapsed/folded position, respectively.
Figure 34:
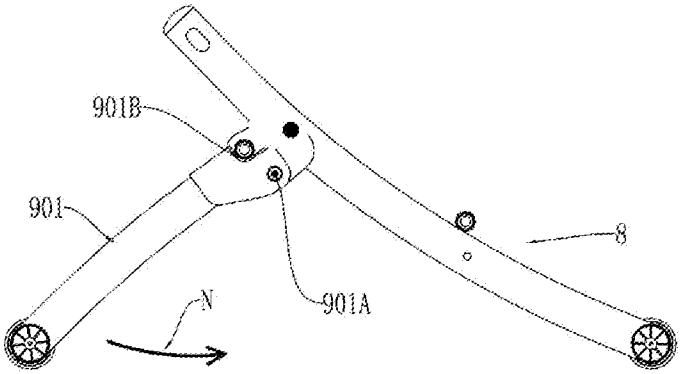

When using the massage chair 100, the front supporting frame (9) is moved forward to the axis (901B), and stops there, as shown in FIG. 34. Once the front supporting frame (9) reaches the spacing, the supporting frame supports the entire massage chair. The front supporting frame may rotate around the axis (901A) for folding, as represented by arrow N in FIG. 34. Specifically, when folding up the massage chair 100, the front supporting frame (9) is moved toward the back support frame 8 by rotating the frame 901 about axis 901A until the front supporting frame 9 folds, as shown in FIG. 35.

Figure 37:
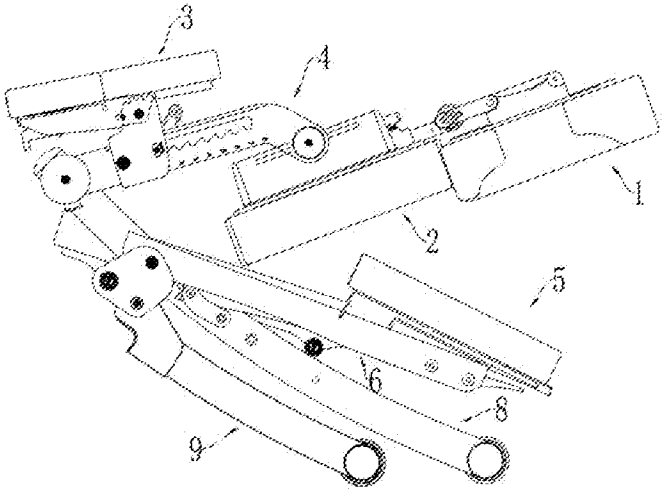
Figure 38:
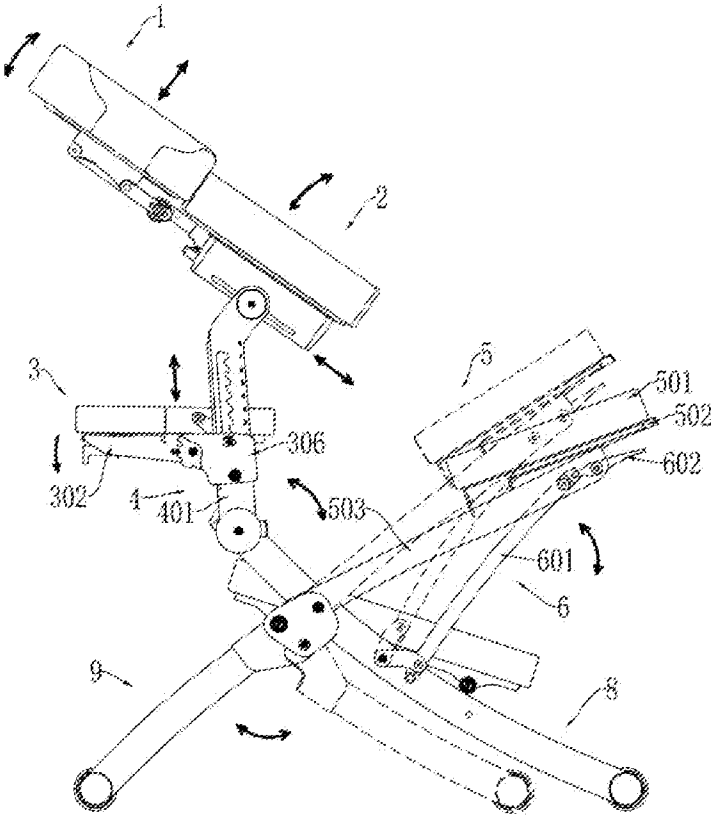

FIGS. 36 and 37 are schematics showing movement of the parts of the massage chair 100 from its expanded position to its collapsed position, respectively. For explanatory and clarity purposes only, the kneeboard assemblies are not illustrated. Generally, FIG. 36 shows the face pillow assembly (1) is rotatably connected to the chest pillow assembly (2), and its height may be adjusted by moving it around when the massage chair 100 is expanded for use. Also, the chest pillow assembly (2) is rotatably connected to the upright post (401), and its length may be adjusted along the sliding slot 401A. The handrail assembly (3) is connected to the upright post (401), and the handrail fastener (306) may be adjusted along the upright post (401). The angle of the handrail plate (302) may also be adjusted. The upright post (401) is rotatably connected to the back supporting frame (8), which may be adjusted by moving it around an axis. The seat assembly (5) is rotatably connected to the supporting frame (8), which may be adjusted by moving it around an axis. The front supporting frame (9) is further rotatably connected to the back supporting frame (8), which may be adjusted by moving it around an axis.

Further, to collapse the chair 100, the parts may be folded by using their connections and rotating the parts about a number of axes. During movement or folding or collapsing, the support rod 4 is rotated towards the back supporting frame 8. The seat assembly 5 can be rotated further downward towards the back supporting frame 8 (as previously described), and the front supporting frame 9 is folded under or towards the back supporting frame 8, to collapse the massage chair as shown in FIG. 37. In an embodiment, the parts of the massage chair 100 are further collapsed as shown in FIG. 4.

In accordance with embodiments herein, the face pillow (101), the chest pillow (201), the handrail (301), the seat cushion (501), and the knee pillow (701) are made of soft materials, such as sponge, so as to be more comfortable to the touch.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed:

1. A foldable massage chair comprising:

a face pillow assembly for supporting a user's head, a chest pillow assembly for supporting the user's chest, a handrail assembly for supporting the user's wrists, a front support rod, a seat cushion assembly, a back support rod, a kneeboard assembly, a back supporting frame, and a front supporting frame;

wherein the face pillow assembly is rotatably connected to the chest pillow assembly, the chest pillow assembly is rotatably connected to the front support rod, the handrail assembly is connected on the front support rod, the front support rod is rotatably connected to the back supporting frame, the seat cushion assembly is rotatably connected to the back supporting frame, and the front supporting frame is rotatably connected to the back supporting frame;

wherein the chair is configured to be moved between an expanded position and a collapsed position; and wherein the front supporting frame and the back supporting frame are both configured for placement on a surface in the expanded position making the massage chair stable, and wherein the back support rod, the seat cushion assembly, and the back supporting frame are connected to form a triangle for supporting the seat cushion in the expanded position;

wherein the handrail assembly includes a handrail cushion provided on a handrail plate, a handle, and an axis pin; wherein the front support rod has a saw-toothed vertical slot with a plurality of teeth; wherein the axis pin is configured for movement into and out of the teeth of the saw-toothed slot via movement of the handle, wherein the handrail assembly is configured for movement in a vertical direction relative to the front support rod via movement of the axis pin within the vertical slot, and wherein the handrail assembly is further configured for rotational movement relative to the front support rod for adjustment of an angle of the handrail plate.

2. The foldable massage chair of claim 1, wherein the face pillow assembly comprises a frame and a face pillow placed on a face pillow plate, wherein the face pillow frame is configured for linear movement to adjust its position relative to the chest pillow assembly, and wherein the face pillow plate is configured for rotational movement to adjust its position relative to the chest pillow assembly.

3. The foldable massage chair of claim 1, wherein the chest pillow assembly comprises a chest pillow attached to a chest pillow plate, and wherein the chest pillow plate is configured to move linearly and rotatably relative the front support rod.

4. The foldable massage chair of claim 1, wherein the front support rod includes a fastener, an axis pin, a compression spring, and a button; wherein the fastener has a slot; wherein the front support rod and the fastener are connected to an end of the back supporting frame and are configured for rotation about the end relative to the back supporting frame; wherein, in the expanded position, spacing on the fastener and the front support rod restrict movement of the front support rod and the button is moved outwardly via the compression spring, and wherein the axis pin is engaged in the slot of the fastener; and wherein, the collapsed position, the axis pin is disengaged from the slot.

5. The foldable massage chair of claim 1, wherein the kneeboard assembly includes kneeboards and a connecting tube; wherein the back supporting frame has a fastening tube; and wherein the connecting tube of the kneeboard assembly runs through the fastening tube on the back supporting frame.

6. The foldable massage chair of claim 1, wherein any one or more of the face pillow assembly, the chest pillow assembly, the handrail assembly, the seat cushion assembly, and/or the knee pillow assembly comprise sponge or cushion materials.

7. A foldable massage chair, comprising:

a face pillow assembly for supporting a user's head, a chest pillow assembly for supporting the user's chest, a handrail assembly for supporting the user's wrists, a front support rod, a seat cushion assembly, a back support rod, a kneeboard assembly, a back supporting frame, and a front supporting frame;

wherein the face pillow assembly is rotatably connected to the chest pillow assembly, the chest pillow assembly is rotatably connected to the front support rod, the handrail assembly is connected on the front support rod, the front support rod is rotatably connected to the back supporting frame, the seat cushion assembly is rotatably connected to the back supporting frame, and the front supporting frame is rotatably connected to the back supporting frame;

wherein the chair is configured to be moved between an expanded position and a collapsed position; and wherein the front supporting frame and the back supporting frame are both configured for placement on a surface in the expanded position making the massage chair stable, and wherein the back support rod, the seat cushion assembly, and the back supporting frame are connected to form a triangle for supporting the seat cushion in the expanded position wherein the seat cushion assembly includes a seat cushion and a seat cushion support rod;

the back support rod includes a base plate support rod, a handle, and a rotation piece; wherein the base plate support rod and the rotation piece form a rotatable connection with the seat cushion support rod and the back supporting frame, respectively;

wherein the seat cushion assembly is configured to move upward such that the base plate support rod and the rotation piece move to extreme points and the handle is configured to move the base plate support rod and the rotation piece beyond their extreme points such that the rotation piece is configured to rotate relative to the back support frame so that the seat cushion assembly is configured for further downward movement; and wherein during the further downward movement, the base plate support rod is supported by the back supporting frame.

8. The foldable massage chair of claim 7, wherein the front supporting frame is placed forward relative to the back supporting frame for supporting the massage chair along with the triangle of the connected base plate support rod, the seat cushion assembly, and the back supporting frame; and wherein, during movement from the expanded position to the collapsed position, the front supporting frame is configured to move towards the back supporting frame for folding.

9. The foldable massage chair of claim 7, wherein the face pillow assembly comprises a frame and a face pillow placed on a face pillow plate, wherein the face pillow frame is configured for linear movement to adjust its position relative to the chest pillow assembly, and wherein the face pillow plate is configured for rotational movement to adjust its position relative to the chest pillow assembly.

10. The foldable massage chair of claim 7, wherein the chest pillow assembly comprises a chest pillow attached to a chest pillow plate, and wherein the chest pillow plate is configured to move linearly and rotatably relative the front support rod.

11. The foldable massage chair of claim 7, wherein the front support rod includes a fastener, an axis pin, a compression spring, and a button; wherein the fastener has a slot; wherein the front support rod and the fastener are connected to an end of the back supporting frame and are configured for rotation about the end relative to the back supporting frame; wherein, in the expanded position, spacing on the fastener and the front support rod restrict movement of the front support rod and the button is moved outwardly via the compression spring, and wherein the axis pin is engaged in the slot of the fastener; and wherein, the collapsed position, the axis pin is disengaged from the slot.

12. The foldable massage chair of claim 7, wherein the kneeboard assembly includes kneeboards and a connecting tube; wherein the back supporting frame has a fastening tube; and wherein the connecting tube of the kneeboard assembly runs through the fastening tube on the back supporting frame.

13. The foldable massage chair of claim 7, wherein any one or more of the face pillow assembly, the chest pillow assembly, the handrail assembly, the seat cushion assembly, and/or the knee pillow assembly comprise sponge or cushion materials.

* * * * *